US005903995A

United States Patent [19]

Brubach

[11] Patent Number: 5,903,995

[45] Date of Patent: May 18, 1999

[54] MONOPOD

[75] Inventor: Bradley C. Brubach, Butler, Pa.

[73] Assignee: Brutis Enterprises, Inc., Pittsburgh, Pa.

[21] Appl. No.: 08/906,397

[22] Filed: Aug. 5, 1997

[51] Int. Cl.[6] ..... F41C 27/00

[52] U.S. Cl. ..... 42/94; 42/90

[58] Field of Search ..... 42/94, 90; 89/37.04

[56] References Cited

U.S. PATENT DOCUMENTS

| | | | |
|---|---|---|---|
| 1,112,732 | 10/1914 | Uhl | 42/94 |
| 3,007,581 | 11/1961 | Moore | 211/64 |
| 4,345,398 | 8/1982 | Pickett | 42/94 |
| 4,393,614 | 7/1983 | Pickett | 42/94 |
| 5,081,782 | 1/1992 | Wright | 42/94 |
| 5,345,706 | 9/1994 | Brown | 42/94 |
| 5,377,437 | 1/1995 | Underwood | 42/94 |
| 5,402,595 | 4/1995 | Tamllos | 42/94 |
| 5,438,786 | 8/1995 | Hilderbrand | 42/94 |

*Primary Examiner*—Charles T. Jordan
*Assistant Examiner*—Meena Chelliah
*Attorney, Agent, or Firm*—Andrew J. Cornelius

[57] ABSTRACT

A device for supporting a hunting rifle, pistol or other firearm that permits the rifle to rotate to allow a full range of targeting while providing stable support in a confined area. The supporting device includes a base to support the device on a surface, a vertical supporting leg and a rest to support a rifle. One end of the supporting device is secured to the base via a swivel and the other end of the supporting device is secured to the rest via a swivel. The swivels provide rotational movement of the supporting leg relative to the base, and rotational movement of the rest, and consequently of the rifle, relative to the supporting leg. The swivels can be set at varying tensions or stiffness. The rifle can be attached to the rest. To aid in the transportation of the rifle and support device, the supporting leg can be folded and clamped onto a clamp of the rest, so that the supporting leg and base are parallel to the rifle.

24 Claims, 4 Drawing Sheets

MONOPOD

BACKGROUND OF THE INVENTION

The present invention relates to monopods, and, more particularly, to a monopod device which provides stable support for a rifle, pistol or other firearm while permitting the firearm to be repositioned easily and effectively to ensure shooting accuracy.

Many hunters use a rifle support system to improve shooting accuracy while hunting. The support system bears most of the rifle's weight which allows the hunter to devote more time and muscular energy toward aiming accurately while hunting.

Various types of support systems exist. The type of support system chosen to be used by the hunter depends on a number of factors, one of which is the hunting location. More explicitly, a support system that is appropriate for use on the ground may not be appropriate if the hunter chooses to hunt from a permanent or portable tree stand.

Many hunters use tree stands to aid in their hunting, especially when hunting creatures of repetitive habits. These tree stands allow the hunter to establish a fixed position on a known animal pathway above the animals' lines of sight and smell. However, to be practical and effective, these tree stands are quite small and provide a limited amount of space for the hunter.

Known monopod rifle support systems generally consist of a U- or V-shaped rifle cradle fixed to the top of a segmented pole or rod or leg of adjustable length. However, the rigid pole and fixed-position rifle cradle make it difficult for hunters to reposition the monopod to adapt to changing shooting situations, especially when hunting from a confined tree stand.

Attempting to maneuver the monopod leg through various positions in both the horizontal and vertical planes in an effort to achieve proper rifle position and stabilization within the confines of a tree stand usually results in an out-of-level rifle position. In other words, the rifle's fixed barrel/sight position tilts away from true vertical when the hunter attempts to maneuver the monopod to aim at an animal approaching from any direction other than directly in front of the supported rifle along the horizon. The horizontal line scribed into most telescopic hunting sights relative to the hunter's perceived horizontal horizon tilts out of alignment when known monopods are tilted along the horizontal or vertical planes. Even a small tilt away from true vertical alignment greatly affects targeting accuracy.

Additionally, the floors of tree stands often consist of steel mesh or thin metal bar flooring with spaces to form a slatted pattern. In attempting to reposition a known monopod support system, the leg or pole or rod often falls through the spacings in the floor of the tree stand.

There exists, therefore, a need for a monopod supporting and stabilizing device for a rifle that can be used to provide level sight alignment of the rifle when the monopod is maneuvered in virtually any position, and that can be easily and stably positioned on the floor of a tree stand.

Firearm supports heretofore devised and utilized for the purpose of hunting are known to consist basically of familiar, expected and obvious structural configurations.

For example, U.S. Pat. No. 1,112,732 to Uhl describes an extendible gun support with a foldable base.

U.S. Pat. No. 4,345,398 to Pickett describes a monopod with a barrel clamp and a pivot clamp that allow the monopod to be folded parallel to the gun and attached to the bottom of the barrel of the gun when not in use.

U.S. Pat. No. 5,402,595 to Tamilas describes a gun support with a ball and cap tilt mechanism located between the top end of the vertical support mechanism and the gun rest for enabling adjustment of declination and inclination of a rifle supported by the rest.

However, the devices mentioned above, while sufficient for their intended uses, do not specifically address the requirement for a monopod that may be used in a tree stand that allows the rifle to be repositioned to allow a full range of targeting while maintaining proper sighting, and which is provided with a stable, effective and sturdy foot support.

SUMMARY OF THE INVENTION

The present invention substantially departs from the conventional concepts and designs of known monopods. No known monopod provides the benefits attributable to the present invention. Additionally, the prior patents identified above do not suggest the present inventive combination of component elements arranged and configured as disclosed and claimed herein.

The present invention provides an improved monopod support system for a hunting rifle, pistol or other firearm. When the monopod is used with a rifle, the rifle can be maneuvered to virtually any position in the horizontal and vertical planes atop the monopod while still maintaining level sight alignment. The present invention is particularly useful when hunting from a tree stand because of the limited space that the invention occupies. The present invention also provides a monopod support system that can be easily and stably positioned on the mesh or slatted flooring of a tree stand.

These and other advantages of the invention will be apparent to those skilled in the art from the following detailed description of a preferred embodiment of the invention.

In light of the foregoing disadvantages in the known types of shooting supports, the preferred monopod provided by the present invention is particularly advantageous because it is configured with omni-directional swivels, which may be located at both ends of a supporting leg or pole or rod of the monopod along a longitudinal axis. One swivel is connected to a rest that attaches to a rifle, and another swivel connects to a base unit. The swivels may be capable of being set or maintained at varying degrees of stiffness.

Each swivel may have a housing, which may be attached to an end of the supporting leg of the monopod. The housing of the swivel and the end of the supporting leg may be designed so that they may be threaded together. The degree to which the swivel and the end of the supporting leg are threaded together determines the amount of stiffness placed in the swivel and the amount of holding force provided by the swivel to stabilize the rifle. That is, the more that the swivel and the end of the supporting leg are threaded together, the greater the amount of stiffness provided by the swivel.

A choke collar may also be used to secure the position of the swivel with respect to the end of the supporting leg. The choke collar can thread onto the end of the supporting leg to tightly press against the swivel and stabilize the swivel in place, thus ensuring that the swivel provides a constant desired stiffness or resistance to movement.

Preferably, the monopod includes a flat base for stabilizing the device on a surface, which surface may include, for example, the ground or the floor of a tree stand. The flat base may extend perpendicularly across the slats or mesh of a tree stand, for example, to provide rigid support for the monopod support system. A swivel is located between the flat base unit and the supporting leg, to join the flat base unit to an end of the supporting leg. Because the flat base unit and the supporting leg are connected via the swivel, the flat base unit can provide consistent and firm support to the supporting leg while the supporting leg rotates through a nearly complete range of vertical and horizontal plane positions. Further, the stiffness provided by the swivel can be fixed or set due using the choke collar.

Additionally, a non-skid device may be adhered to the bottom of the flat base unit or flat footplate, that is, to the surface of the flat base unit that contacts the floor of the tree stand or the ground, to prevent the monopod from sliding.

In one possible embodiment, the base unit can be a pointed tip that can be driven into the ground, for example, to provide rigid support for the monopod. The swivel and the flat base unit footplate can be detached from the supporting leg and the pointed tip base unit can be threaded directly onto the supporting leg.

The present invention also provides a rest for supporting a rifle. The rest may be a cradle. A swivel can be used to attach the rest to the end of the supporting leg that is opposite the end of the supporting leg that attaches to the base unit. Because the rest is "fixedly" attached to the swivel, and the rest and the supporting leg are connected via the swivel, the supporting leg can provide consistent and firm support to the rest while the rest rotates through a wide range of vertical and horizontal plane positions. Further, the degree of resistance to movement provided by the rest can be set by the choke collar.

In accordance with one possible embodiment, the rest comprises an attachment device that can serve to attach the rifle to the rest. The attachment device can be straps. Additionally, Velcro fasteners can be adhered to the top surface of the rest and to the bottom of the rifle to aid in securing the rifle to the rest.

In accordance with one embodiment of the present invention, the supporting leg can be an adjustable pole.

The above discussed embodiments provided by the present invention will be described further hereinbelow with reference to the accompanying figures. When the word "invention" is used in this specification, the word "invention" includes "inventions," and the Applicant does not in any way admit that the present application does not include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The following detailed description of the preferred embodiment may be understood better if reference is made to the appended drawing, in which.

DETAILED DESCRIPTION OF THE PREFERRED EMBODIMENT

Figures 1, 4:
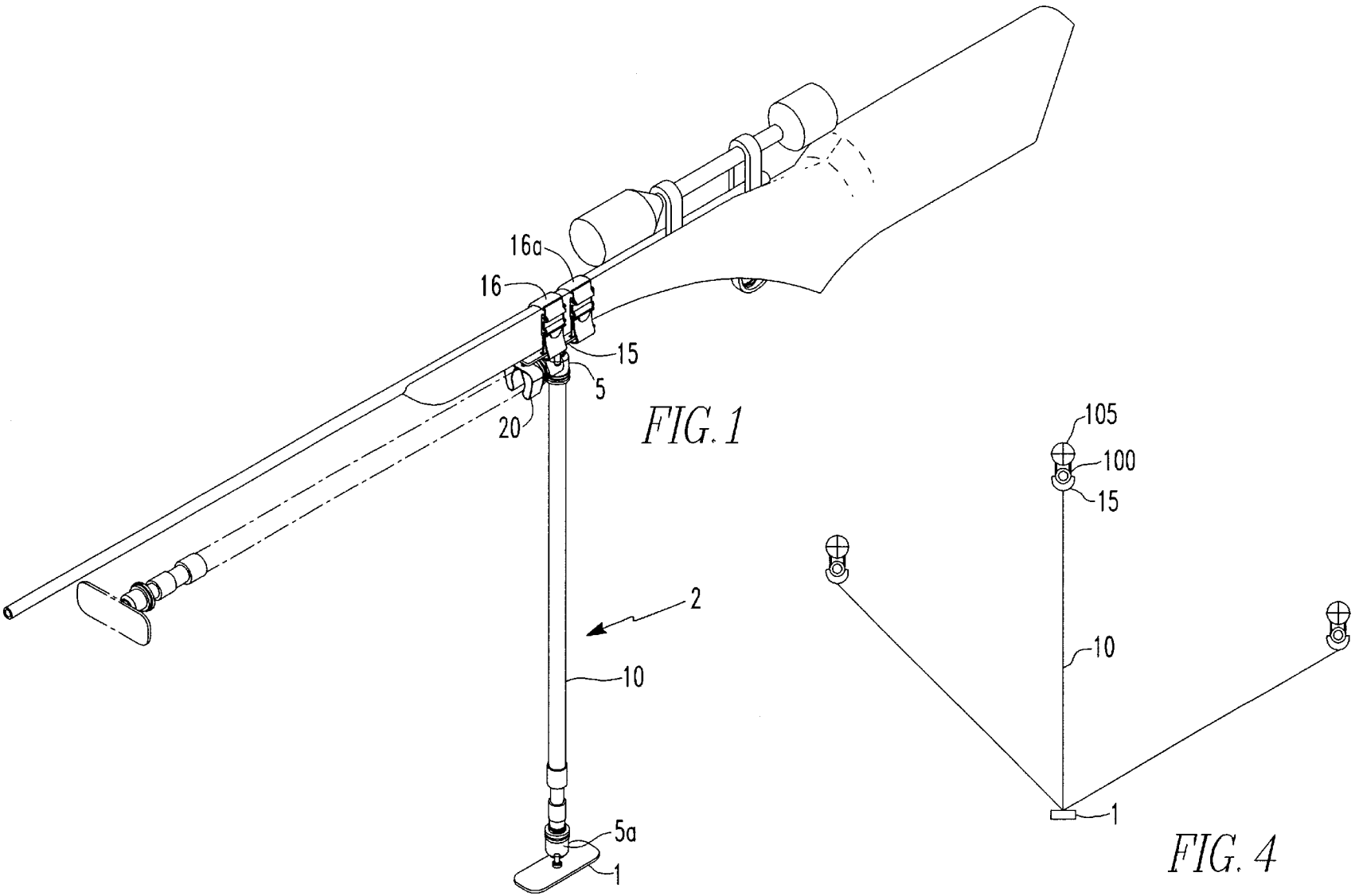
FIG. 1 shows an isometric view of the preferred monopod provided by the present invention, in which the monopod is shown attached to and supporting a rifle, and attached, folded and clamped onto a rifle.
FIG. 4 is a graphical view of the device shown in FIG. 1 and a scope of a rifle in combination and in three different positions, where the scope of the rifle is leveled in every position.

The monopod provided by the present invention can be used to support and stabilize a rifle, pistol or other firearm. FIG. 1 shows a monopod 2 that is adapted for use with a hunting rifle. The supporting leg 10 of the monopod 2 is shown in two different positions with respect to the rifle 100. The supporting leg 10 of the monopod 2 is shown perpendicular to the rifle 100, and also shown in phantom parallel and clamped to the rifle 100. When the supporting leg 10 extends perpendicular to the rifle 100 it can rest on a surface, such as the flooring of a tree stand, to support and stabilize the rifle 100. When the supporting leg 10 is positioned parallel to the rifle 100 it can be clamped onto the rifle 100 via clamp 20. The parallel position of the supporting leg 10 with respect to the rifle 100 results in a compact monopod/rifle configuration that can easily be carried and transported.

Monopod 2 includes a flat base unit 1 that is positioned on a surface, a supporting leg 10 that is attached at one end to the base unit via a swivel 5*a,* a rest or cradle 15 that supports a rifle 100, which rifle 100 is attached to the cradle 15 via two 1 inch nylon straps 16, 16*a,* and which cradle 15 is attached to the remaining end of the supporting leg 10 via a swivel 5. Velcro (not shown) is adhered to the top surface of the cradle 15 and to the bottom of the rifle 100 to aid in securing the rifle 100 to the cradle 15.

Figure 2:
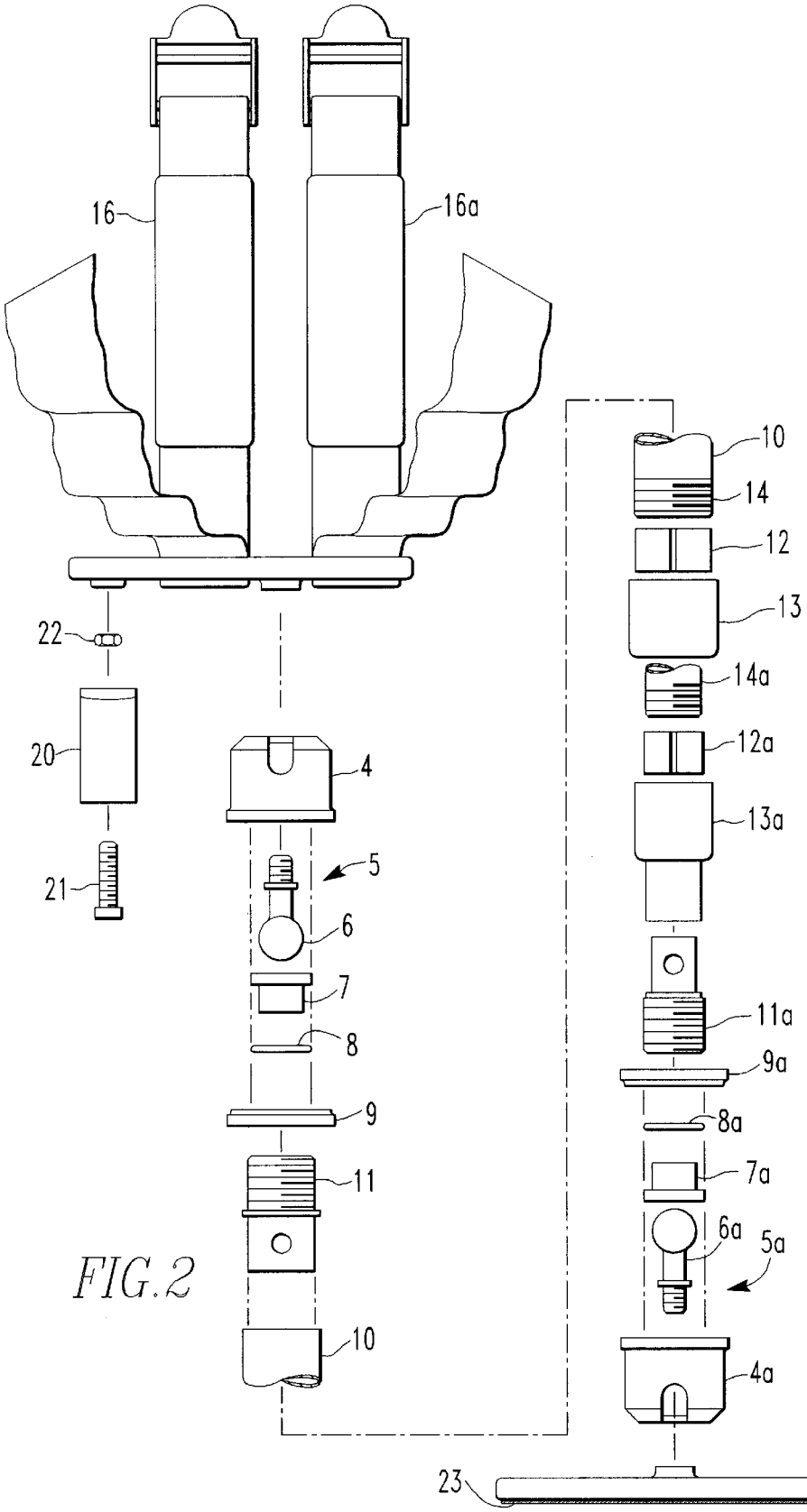
FIG. 2 is an exploded view of the device shown in FIG. 1.

FIG. 2 is an exploded view of the monopod shown in FIG. 1. Each swivel 5, 5*a* has a housing 4, 4*a,* a rotating mechanism 6, 6*a* and a socket portion 7, 7*a* located within the housing of the swivel 5, 5*a*. The rotating mechanism 6, 6*a* may include a round, ball portion and an elongated post portion, which elongated post portion extends from the round ball portion of the rotating mechanism 6, 6*a*. The socket portion 7, 7*a* provides the surface onto which surface the ball portion of the rotating mechanism 6, 6*a* rotates.

Each swivel 5, 5*a* can also include a washer 8, 8*a,* which washer 8, 8*a* may be located circumferentially around the socket portion 7, 7*a* of the swivel 5, 5*a,* and which washer 8, 8*a* facilitates maintaining a constant, set or fixed tension or stiffness in the swivel 5, 5*a*. The washer 8, 8*a* is made of a rubber material.

The support leg 10 is provided with two threaded attachment inserts 11, 11*a*. The threaded attachment inserts 11, 11*a* may be inserted in both ends of the support leg 10, and the support leg may be crimped so that the threaded attachment inserts 11, 11*a* are fixedly held in place. The swivel housings 4, 4*a* and the threaded attachment inserts 11, 11*a* are threaded and designed so that they may be threaded together. The degree to which the swivel housings 4, 4*a* and the threaded attachment inserts 11, 11*a* of the support leg 10 are threaded together determines the amount of tension or stiffness (resistance to movement) set in the swivel 5, 5*a*.

Choke collars 9, 9*a* are located circumferentially around the threaded attachment inserts 11, 11*a*. The choke collars 9, 9*a* can be threaded around the threaded attachment inserts 11, 11*a* in the direction opposite to the direction that the swivel housings 4, 4*a* thread onto the threaded attachment inserts 11, 11*a*. This can result in choke collars 9, 9*a* being tightly pressed against the swivel housings 4, 4*a* to maintain the swivel housings 4, 4*a* in their threaded positions around the threaded attachment inserts 11, 11*a,* thus ensuring that the swivels 5, 5*a* provide a constant desired tension or stiffness as they rotate.

The cradle 15 may be fixedly attached to the elongated, post portion of the rotating mechanism 6 of the swivel 5. Therefore, the cradle 15 may also rotate against a constant desired tension or stiffness.

The flat base unit 1 may be fixedly attached to the elongated, post portion of the rotating mechanism 6*a* of the swivel 5*a*. Therefore, the flat base unit 1 may also rotate against a desired tension or stiffness.

A clamp 20 may be attached to the cradle 15 via a ¾ inch bolt 21 and a nut 22. When the monopod is not being used, the supporting leg 10 may be folded upward (due to the swivel 5) and snapped into the clamp 20, so that the supporting leg 10 and the rifle 100 (see FIG. 1) are parallel to one another.

Bolt 21 and nut 22 allow clamp 20 to adjust for rifles with different angles of stock. The adjustability of clamp 20 allows supporting leg 10 to maintain a horizontal plane and keeps supporting leg 10 aligned with the barrels of rifles of varying sizes.

Figure 3:
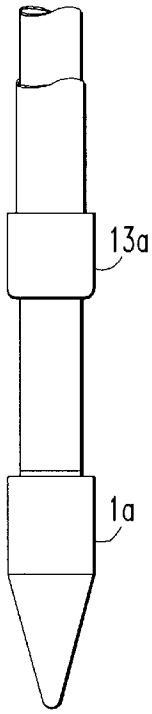
FIG. 3 shows an additional embodiment of the base of the device shown in FIG. 1.

FIG. 3 shows a pointed base unit 1*a* which may be used instead of the flat base unit 1 (see FIG. 2). The base unit 1*a* may be particularly useful when the monopod is used on the ground because the pointed tip of base unit 1*a* may be embedded into the ground to provide sturdy support. The swivel 5*a* and the flat base unit 1 can be detached from the threaded attachment insert 11*a* of the supporting leg 10 and the pointed base unit 1*a* can be threaded directly onto the threaded attachment insert 11*a* of the supporting leg 10. The base unit 1*a* can be made of machine aluminum.

FIG. 4 shows graphically the supporting leg 10, rifle 100 and rifle scope 105 in three different positions. As shown in FIG. 4, when the supporting leg 10 is tipped in virtually any direction, the cradle or rest 15 (see FIG. 2) may be adjusted so that the rifle 100 and consequently the rifle scope 105 can be leveled to provide proper, level sight alignment.

Figure 5:
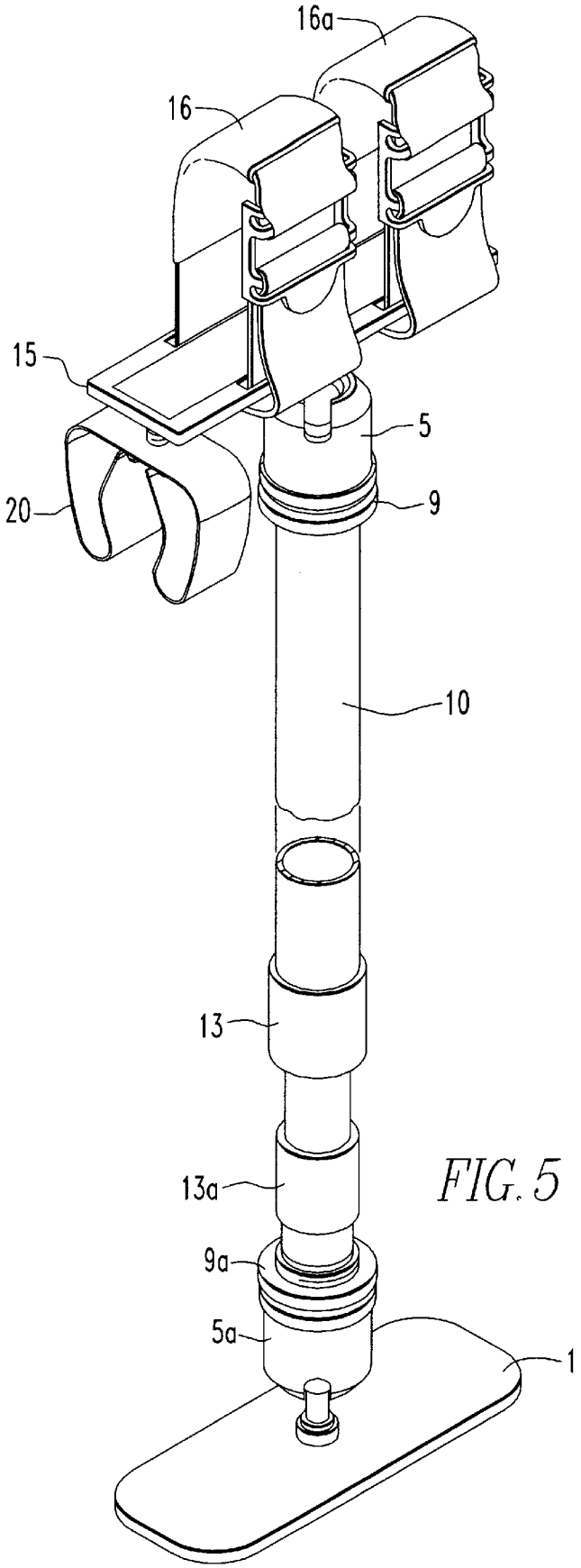
FIG. 5 is a perspective view of the device shown in FIG. 1 shown in greater detail.

FIG. 5 shows a perspective view of the monopod shown in FIG. 1 in greater detail.

Figure 6:
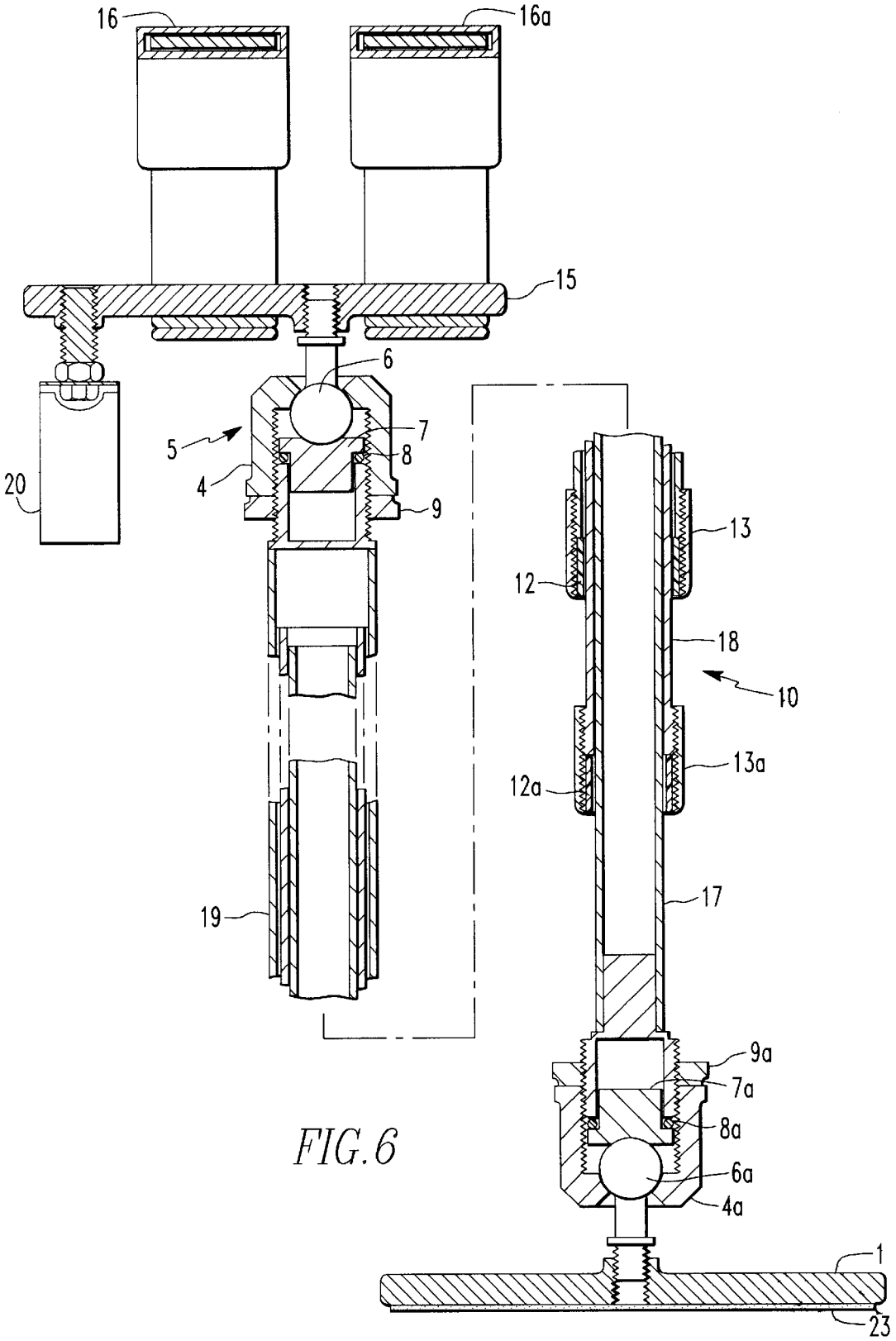
FIG. 6 shows the device shown in FIG. 5 in axial section.

As shown in FIG. 6, the support leg 10 may comprise three hollow sections 17, 18, 19 which telescope with one another to provide a supporting leg 10 of adjustable length. Section 18 is of slightly greater diameter than section 17, and section 19 is of slightly greater diameter than section 18. Section 18 may telescope out of or collapse inside of section 19, and section 17 may telescope out of or collapse inside of section 18, resulting in a support leg 10 of variable length. The support leg 10 may range from approximately 26 to 60 inches. The support leg 10 may be aluminum.

Section 17 may be secured to section 18 via threaded connecting sleeve 13*a*. Section 18 may be secured to section 19 by threading connecting sleeve 13 onto threaded end 14*a* of section 18. Threaded connecting sleeve 13 is located circumferentially around section 18, and is configured to thread onto a threaded end 14 (see FIG. 2) of section 19. Similarly, threaded connecting sleeve 13*a* is located circumferentially around section 17, and is configured to thread into a threaded end 14*a* of section 18.

When the threaded connecting sleeve 13 and the threaded end 14 (see FIG. 2) of section 19 are completely threaded together, section 18 is "locked" into place and section 18 cannot telescope out of or slide into section 19. The more that the threaded connecting sleeve 13 and the threaded end 14 of section 19 are "un-threaded," that is, the more that the connection is loosened, the easier it becomes to move section 18 into out of section 19.

Similarly, when the threaded connecting sleeve 13*a* and the threaded end 14*a* of section 18 are completely threaded together, section 17 is "locked" into place and section 17 cannot telescope out of or slide into section 18. The more that the threaded connecting sleeve 13*a* and the threaded end 14*a* of section 18 are "un-threaded," that is, the more that the connection is loosened, the easier it becomes to move section 17 into our out of section 18.

Threaded connecting sleeve 13 is provided with a connecting stabilizer 12, and threaded connecting sleeve 13*a* is provided with a connecting stabilizer 12*a*. The connecting stabilizers 12, 12*a* may be split plastic washer pieces.

Connecting stabilizer 12 fits circumferentially around section 18, and threaded connecting sleeve 13 fits over connecting stabilizer 12. Therefore, when threaded connecting sleeve 13 threads together with section 19, connecting stabilizer 12 is pressed into or firmly against section 19 thus ensuring a stable and sturdy connection. Connecting stabilizer 12*a* fits circumferentially around section 17, and threaded connecting sleeve 13*a* fits over connecting stabilizer 12*a*. Therefore, when threaded connecting sleeve 13*a* threads together with section 18, connecting stabilizer 12*a* is pressed into or firmly against section 18 thus ensuring a stable and sturdy connection. Connecting stabilizers 12, 12*a* are split to facilitate mounting them in place on sections 18 and 17, respectively.

Additionally, as shown in FIG. 6, a non-skid device 23 may be attached to the underside of the flat base unit 1 to prevent skidding and to provide a more sturdy support for the monopod 2. The non-skid device 23 may be non-skid tape.

Monopod 2 can be used to provide support to a rifle 100 to permit a rifle 100 to be resighted and repositioned angularly and vertically to allow a full range of targeting while providing stable support in a confined area, such as a tree stand. Supporting leg 10 of monopod 2 can be attached to a flat base unit 1 via a swivel 5. Flat base unit 1 is designed to extend across the mesh or slated flooring of a tree stand thus preventing monopod 2 from falling through the flooring of the tree stand. Swivel 5 allows supporting leg 10 to rotate relative to base unit 1 while base unit 1 remains in place thus providing sturdy, secure and stable support.

Cradle 15 is attached to the other end of supporting leg 10 via swivel 5*a*. Rifle 100 rests on and is attached to cradle 15 via attachment straps 16, 16*a*. Swivel 5*a* allows cradle 15, and consequently rifle 100 to rotate relative to supporting leg 10.

Therefore swivels 5 and 5*a* essentially allow rifle 100 to rotate and move to allow a full range of targeting, while base unit 1 remains securely in place on the flooring of the tree stand.

Choke collars 9, 9*a* aid in allowing varying tension or stiffness to be set in swivels 5 and 5*a* respectively. Choke collars 9, 9*a* thread onto the end of the supporting leg 10 in the direction opposite to the direction that swivels 5, 5*a* thread with the ends of the supporting leg 10. Thus, when swivels 5, 5*a* are threaded onto the ends of supporting leg 10 and are at the desired tension, choke collars 9, 9*a* may be "threaded into" and abut swivels 5, 5*a* respectively, to hold them in place.

The supporting leg 10 includes portions 17, 18 and 19 which have different diameters and which telescope into and out of one another. These portions can be secured by connecting sleeves 13, 13*a* so that the supporting leg 10 can range from 26 to 60 inches.

Rest 15 is provided with a clamp 20. Therefore, when the monopod 2 is being transported, supporting leg 10 may fold at swivel 5, and supporting leg 10 can be attached underneath and parallel to the rifle by clamp 20.

To use monopod 2, rifle 100 is attached to the rest 15 of monopod 2 via the attachment devices 16, 16*a*. Supporting leg 10 may be folded at swivel 5 and secured into clamp 20 to prepare the rifle 100 and monopod 2 for transport. This attached, compact configuration of monopod 2 and rifle 100 allows for easy transportation to the hunting site.

Once at the hunting site, the hunter detaches the supporting leg 10 from clamp 20. If hunting from a tree stand, the hunter attaches swivel 5*a* and base unit 1 to section 17 of leg 10 by threading swivel 5*a* onto threaded section 11*a*. Base unit 1 is then securely positioned on the floor of the tree stand. The hunter can adjust the degree of difficulty with which base 1 can be repositioned relative to leg 10 by adjusting the position of housing 4*a* on threaded section 11*a* to adjust the tension or stiffness of swivel 5*a*. The further housing 4*a* of swivel 5*a* is threaded onto the end 17 of the supporting leg 10, the more difficult it is to swivel base 1. The hunter adjusts the position of housing 4*a* on end 17 by rotating choke collar 9*a* until it is no longer engaged with housing 4*a,* and rotating housing 4*a* until the desired level of stiffness of swivel 5*a* is achieved, at which point choke collar 9*a* is again rotated to tighten it against housing 4*a* to lock it into place. The hunter can adjust the position of base 1 relative to leg 10 either by simply rotating base 1 on swivel 5*a,* if the degree of stiffness of swivel 5*a* is not too great, or by adjusting the stiffness of base 1 as described above, repositioning base 1, and resetting the stiffness of swivel 5*a* as desired.

Base unit 1 is configured to extend across the slats or mesh flooring of the tree stand to provide stable support to the monopod 2 and rifle 100. Non-stick device 23, which is adhered to the underside of base unit 1, contacts the flooring of the tree stand to reduce skidding and to provide a more sturdy support for monopod 2.

Sections 17, 18 and 19 of the supporting leg 10 are designed to telescope with one another so that monopod 2 and rifle 100 may be adjusted to the desired height for targeting. Connecting sleeve 13 is designed to fasten sections 18 and 19 together. Section 18 is designed to telescope into and out of section 19. To adjust the overall length of sections 18 and 19, sleeve 13 is rotated on section 14 until it is loosened and sections 18 and 19 can be slid with respect to each other until the desired overall length is achieved. Once the desired position of section 18 with respect to section 19 is reached, connecting sleeve 13 may be tightened by threading it further onto end 14 of section 19. As connecting sleeve 13 and threaded end 14 of section 19 are threaded together, connecting stabilizer 12 is pressed against section 19 thus ensuring a stable, sturdy connection. Similarly, sleeve 13*a* is designed to fasten sections 17 and 18 together. Section 17 is designed to telescope into and out of section 18. To adjust the overall length of sections 18 and 17, sleeve 13*a* is rotated on section 14*a* until it is loosened and sections 18 and 17 can be slid with respect to each other until the desired overall length is achieved. Once the desired position of portion 17 with respect to portion 18 is reached, connecting sleeve 13*a* is tightened to thread sleeve 13*a* further onto threaded section 14*a* of section 18. As connecting sleeve 13*a* is threaded further onto section 14*a* of portion 18, connecting stabilizer 12*a* is pressed against portion 18 thus ensuring a stable sturdy connection. The overall length of monopod 2 can be readjusted by readjusting the combined lengths of sections 19 and 18, and sections 18 and 17, as described above.

The stiffness at which the swivels 5, 5*a* is set determines the amount of force that must be exerted to adjust the position of rifle 100 relative to the position of leg 10 to tilt monopod 2 and resight rifle 100. Adjustment of the stiffness of swivels 5, 5*a* involves a trade-off. If swivels 5, 5*a* is set to be very stiff, monopod 2 provides a high degree of stability for rifle 100, but repositioning rifle 100 will be more difficult, either because the hunter will need to overcome a higher level of resistance to reposition cradle 15 and base 1 or because the hunter will need to adjust the stiffness of swivels 5, 5*a* to a lower level, adjust the position of cradle 15 and base 1, and readjust the stiffness of swivels 5, 5*a* to the former, higher level. If swivels 5, 5*a* are set to a low level of stiffness, repositioning of rifle 100 becomes easier, but monopod 2 will provide a lower degree of stability.

The hunter may adjust the stiffness of swivel 5 by rotating choke collar 9 until it is no longer engaged with housing 4. Once the desired stiffness of swivel 5 is reached, choke collar 9 is rotated until it is engaged with housing 4, and the stiffness of swivel 5 is set.

Monopod 2 permits the hunter to resight by aiming in a new direction and, if desired, lowering rifle 100 while maintaining a level sight alignment and maintaining base 1 in contact with the floor of the tree stand by allowing the hunter to tilt leg 10 while maintaining the orientation of rifle 100. Tilting leg 10 causes cradle 15 and base 1 to swivel on swivels 5 and 5*a,* respectively. The supporting leg 10 of monopod 2 swivels at swivel 5*a* while base unit 1 remains securely on the floor of the tree stand. Rest 15 and rifle 100 rotates at swivel 5*a* so that the scope 105 of rifle 100 can always be adjusted for level sight alignment. Therefore, base unit 1 can remain firmly in place on the floor of the tree stand, while supporting leg 10 can swivel in any direction via swivel 5*a,* and rest 15 and rifle 100 can swivel in any direction via swivel 5. Consequently, a target approaching from any direction can be aimed at and the sight 105 can be leveled, while the base unit 1 remains in the same stable position on the floor of the tree stand.

To hunt from the ground, swivel 5*a* and base unit 1 are unthreaded and detached from the supporting leg 10. Pointed tip 1*a* is threaded onto end 11*a* and secured in the same manner in which base 1 and swivel 5*a* were mounted to leg 10 to replace swivel 5*a* and base unit 1. Pointed tip 1*a* is embedded into the ground to provide a sturdy, stable base for monopod 2. Supporting leg 10 may be adjusted to the desired height by adjusting the combined length of telescoping portions 17, 18 and 19 as described above.

After hunting, supporting leg 10 is folded upward at swivel 5 to attach to the underside of and parallel to the rifle 100 via clamp 20.

Monopod 2 can be readily adapted for use with pistols or other firearms, as will be apparent to those of ordinary skill in the art.

The appended drawings in their entirety, including all dimensions, proportions, and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents and publications recited herein, and in the Declaration attached hereto, are hereby incorporated by reference as if set forth in their entirety herein.

The details in the patents and publications may be considered to be incorporable, at Applicant's option, into the claims during prosecution as further limitations in the claims to patentably distinguish any amended claims from any applied prior art.

Although only a few exemplary and preferred embodiments of this invention have been described in detail above, those skilled in the art will readily appreciate that many modifications are possible in the exemplary embodiments without materially departing from the novel teachings and advantages of this invention. Accordingly, all such modifications are intended to be included within the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A device for supporting a rifle above a surface, said device comprising:

a base for stabilizing said device on the surface;

a supporting leg comprising a first end and a second end;

a first swivel disposed between said base and said first end of said supporting leg;

said first swivel being configured and disposed to enable rotational adjustment of said supporting leg relative to said base;

a rest for supporting a rifle; and a second swivel disposed between said second end of said supporting leg and said rest;

said second swivel being configured and disposed to enable rotational adjustment of said rest relative to said supporting leg;

said first and second swivels allowing resighting of the rifle while maintaining a level sight alignment.

2. The device according to claim 1 further comprising:

a first choke collar and a second choke collar;

said first choke collar being disposed circumferentially around said first end of said supporting leg;

said first choke collar being disposed to aid in maintaining tension in said first swivel;

said second choke collar being disposed circumferentially around said second end of said supporting leg; and said second choke collar being disposed to aid in maintaining tension in said second swivel.

3. The device according to claim 2 wherein:

said rest includes an attachment device; and said attachment device is disposed to attach a rifle to said rest.

4. The device according to claim 3 wherein said rest includes a clamping device; and said clamping device is configured and disposed to secure said supporting leg parallel to an attached rifle.

5. The device according to claim 4 wherein said supporting leg comprises a plurality of portions telescopically interconnected together.

6. The device according to claim 5 wherein said rest is a cradle.

7. The device according to claim 6 wherein said attachment device comprises straps.

8. The device according to claim 7 further comprising a non-skid device being disposed on the side of said base that contacts the surface.

9. A device for supporting a rifle above a surface, said device comprising:

a base unit for stabilizing said device on a surface;

a supporting leg comprising a first threaded end and a second threaded end;

a first swivel being disposed between said base unit and said first end of said supporting leg;

said first swivel being configured and disposed to enable adjustment of said supporting leg relative to said base unit; and said first swivel comprising:

a housing;

said housing comprising a threaded portion;

said threaded portion of said housing being configured and disposed to thread with said first end of said supporting leg to provide tension to said first swivel;

a rotating mechanism being disposed within said housing;

said rotating mechanism comprising a ball portion and an elongated post portion extending from said ball portion;

a socket portion being disposed within said housing;

said socket portion comprising a surface;

said ball portion of said rotating mechanism being disposed to contact and rotate on said surface of said socket portion;

a washer being disposed around said socket portion; and said washer being disposed to aid in maintaining tension in said first swivel;

said base being disposed to be attachable to said elongated post portion of said rotating mechanism of said first swivel;

a rest for supporting a rifle;

a second swivel disposed between said second end of said supporting leg and said rest;

said second swivel being configured and disposed to enable rotational adjustment of said rest relative to said supporting leg; and said second swivel comprising:

a housing;

said housing comprising a threaded portion;

said threaded portion of said housing being configured and disposed to thread with said second end of said supporting leg to provide tension to said second swivel;

a rotating mechanism being disposed within said housing;

said rotating mechanism comprising a ball portion and an elongated post portion extending from said ball portion;

a socket portion being disposed within said housing;

said socket portion comprising a surface;

said ball portion of said rotating mechanism being disposed to contact and rotate on said surface of said socket portion;

a washer being disposed around said socket portion; and said washer being disposed to aid in maintaining tension in said second swivel;

said rest being disposed to be attachable to said elongated post portion of said rotating mechanism of said second swivel;

said rest being disposed to rotate in response to the rotational movement of said second swivel;

said rest comprising an attachment device; and said attachment device being disposed to attach a rifle to said rest.

10. The device according to claim 9 further comprising a first choke collar and a second choke collar;

said first choke collar being disposed circumferentially around said first threaded end of said supporting leg;

said first choke collar being disposed to aid in maintaining the tension in said first swivel;

said second choke collar being disposed circumferentially around said second threaded end of said supporting leg; and said second choke collar being disposed to aid in maintaining the tension in said second swivel.

11. The device according to claim 10 wherein said rest comprises a clamping device; and said clamping device being configured and disposed to secure said supporting leg parallel to and adjacent an attached rifle.

12. The device according to claim 11 wherein said supporting leg comprises a plurality of portions telescopically interconnected together.

13. The device according to claim 12 wherein said rest is a cradle.

14. The device according to claim 13 wherein said attachment device comprises straps.

15. The device according to claim 14 wherein:

said base unit is a pointed tip;

said pointed tip base unit being configured and disposed to be embedded into a surface to support said device.

16. A device for supporting a rifle above a surface, said device comprising:

a base unit for stabilizing said device on a surface;

a supporting leg comprising a first threaded end and a second threaded end;

said first end of said supporting leg being configured and disposed to connect to said base unit;

a rest for supporting a rifle;

a swivel disposed between said second end of said supporting leg and said rest;

said swivel being configured and disposed to enable rotational adjustment of said rest relative to said supporting leg; and said swivel comprising:

a housing;

said housing comprising a threaded portion;

said threaded portion of said housing being configured and disposed to thread with said second end of said supporting leg to provide tension to said swivel;

a rotating mechanism being disposed within said housing;

said rotating mechanism comprising a ball portion and an elongated post portion extending from said ball portion;

a socket portion being disposed within said housing;

said socket portion comprising a surface;

said ball portion of said rotating mechanism being disposed to contact and rotate on said surface of said socket portion;

a washer being disposed around said socket portion; and said washer being disposed to aid in maintaining tension in said swivel;

said rest being disposed to be attachable to said elongated post portion of said rotating mechanism of said swivel;

said rest being disposed to rotate in response to the rotational movement of said swivel;

said rest comprising an attachment device; and said attachment device being disposed to attach a rifle to said rest.

17. The device according to claim 16 wherein:

said base unit is a pointed tip; and said pointed tip base unit being configured and disposed to be embedded into a surface to support said device.

18. The device according to claim 17 wherein said supporting leg comprises a plurality of portions telescopically interconnected together.

19. The device according to claim 18 further comprising a choke collar;

said choke collar being disposed circumferentially around said second threaded end of said supporting leg; and said choke collar being disposed to aid in maintaining the tension in said swivel.

20. The device according to claim 19 wherein:

said rest is a cradle;

said attachment device comprises straps;

said rest comprises a clamping device; and said clamping device being configured and disposed to secure said supporting leg parallel to an attached rifle.

21. A device for stabilizing the position of a firearm above a surface comprising:

a supporting leg having a first end and a second end;

a base at said first end of said supporting leg for stabilizing said device on the surface;

a first swivel between said base and said first end of said supporting leg, said first swivel being configured and disposed to enable adjustment of the position of said supporting leg relative to said base;

a rest for supporting the firearm; and a second swivel disposed between said second end of said supporting leg and said rest;

said second swivel being configured and disposed to enable adjustment of the position of said rest and the firearm relative to said supporting leg;

said first and second swivels allowing resighting of the rifle while maintaining a level sight alignment.

22. A device for supporting a rifle above a surface, said device comprising:

a base for stabilizing said device on the surface;

a supporting leg comprising a first end and a second end;

a first swivel disposed between said base and said first end of said supporting leg;

said first swivel being configured and disposed to enable rotational adjustment of said supporting leg and said base relative to one another in all directions;

a rest for supporting the rifle; and a second swivel disposed between said second end of said supporting leg and said rest;

said second swivel being configured and disposed to enable rotational adjustment of said rest and said supporting leg relative to one another in all directions;

said first and said second swivels allowing resighting of the rifle while maintaining a level sight alignment.

23. The device recited by claim 22 wherein each said swivel includes a ball and socket assembly.

24. A device for supporting a rifle above a surface comprising:

a base for stabilizing said device on the surface;

a supporting leg comprising a first end and a second end;

first mounting means disposed between said base and said first end of said supporting leg for securing said base to said first end of said supporting leg to permit said first mounting means to rotate in any direction relative to said supporting leg;

a rest for supporting a rifle; and second mounting means disposed between said second end of said supporting leg and said rest for securing said rest to said second end of said supporting leg to permit said second mounting means to rotate in any direction relative to said supporting leg;

said first and second mounting means for allowing resighting of the rifle while maintaining a level sight alignment.

* * * * *